US005083541A

United States Patent [19]

Chen

[11] Patent Number: 5,083,541

[45] Date of Patent: Jan. 28, 1992

[54] METHOD AND SYSTEM FOR CONTROLLING ENGINE IDLE SPEED

[75] Inventor: Bor-Dong Chen, Dearborn, Mich.

[73] Assignee: Ford Motor Company, Dearborn, Mich.

[21] Appl. No.: 625,231

[22] Filed: Dec. 10, 1990

[51] Int. Cl.[5] ..... F02D 41/16

[52] U.S. Cl. ..... 123/339; 123/362

[58] Field of Search ..... 123/339, 362

[56] References Cited

U.S. PATENT DOCUMENTS

| | | | |
|---|---|---|---|
| 4,344,398 | 8/1982 | Ikeura | 123/339 |
| 4,344,399 | 8/1982 | Matsumura et al. | 123/339 |
| 4,345,557 | 8/1982 | Ikeura | 123/339 |
| 4,402,289 | 9/1983 | Ikeura | 123/339 |
| 4,457,276 | 7/1984 | Ueda et al. | 123/339 |
| 4,484,553 | 11/1984 | Kobayashi et al. | 123/339 |
| 4,557,234 | 12/1985 | Ito | 123/339 |
| 4,570,592 | 2/1986 | Otobe | 123/339 |
| 4,572,141 | 2/1986 | Hasegawa et al. | 123/339 |
| 4,580,535 | 4/1986 | Danno et al. | 123/339 |
| 4,625,697 | 12/1986 | Hosaka | 123/339 |
| 4,681,075 | 7/1987 | Yamato et al. | 123/339 |
| 4,688,534 | 8/1987 | Takeda et al. | 123/339 |
| 4,691,675 | 9/1987 | Iwaki | 123/339 |
| 4,702,210 | 10/1987 | Yasuoka et al. | 123/339 |
| 4,716,871 | 1/1988 | Sakamoto et al. | 123/339 |
| 4,721,083 | 1/1988 | Hosaka | 123/339 |
| 4,742,807 | 5/1988 | Sakamoto et al. | 123/339 |
| 4,747,379 | 5/1988 | Oba | 123/339 |

*Primary Examiner*—Andrew M. Dolinar

*Attorney, Agent, or Firm*—Peter Abolins; Clifford L. Sadler

[57] ABSTRACT

An engine idle speed control (ISC) method includes fully opening an idle speed control valve during an engine crank mode and opening the idle speed control valve to a fixed position during a diagnostic mode. The normal idle speed control mode includes selecting an open-loop idle speed control mode or a closed-loop idle speed control mode as a function of dashpot preposition, dashpot control, Pre-RPM control, RPM control, and RPM lockout protection. In the open-loop idle speed control, the duty cycle is the sum of a base duty cycle, a dashpot action adder, an engine coolant temperature compensation adder, a time-since-engine-start compensation adder, and other duty cycle adders for additional loads, such as air-conditioner. In the closed-loop idle speed control, the duty cycle is adjusted at the proper time and with an appropriate amount to maintain the idling speed at the desired speed.

29 Claims, 11 Drawing Sheets

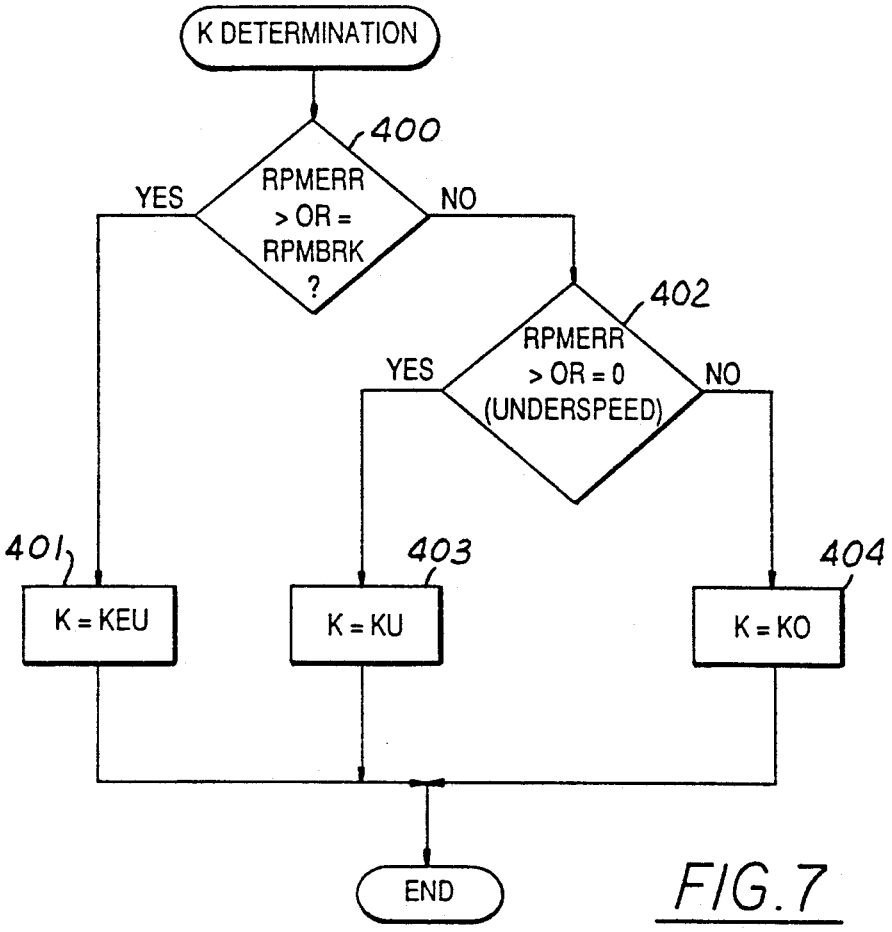
FIG. 7
FIG. 8
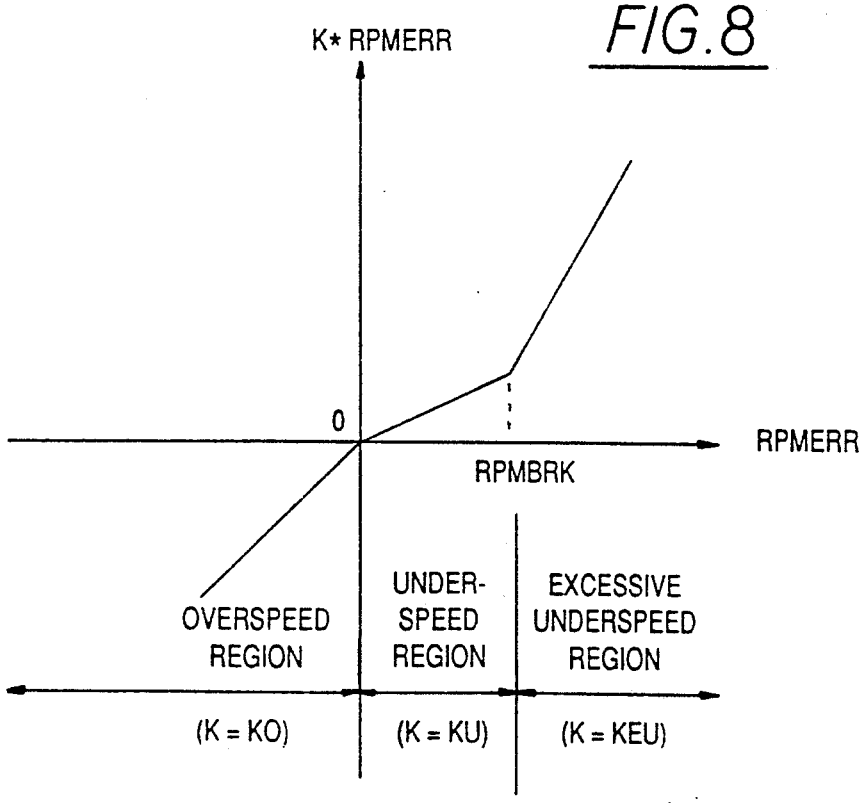

METHOD AND SYSTEM FOR CONTROLLING ENGINE IDLE SPEED

BACKGROUND OF THE INVENTION

1. Field of the Invention

The present invention relates to the field of controlling the engine idling speed at the desired speed by controlling the degree of opening of the valve in the air bypass passage connecting the pair passage upstream and downstream of a throttle valve. The desired engine idling speed is advantageously set so that both fuel economy and acceptable emission levels are achieved.

2. Prior Art

U.S Pat. No. 4,747,379 discloses an idle speed control device in which the closed-loop control and open-loop control together with the learning control are carried out to control the engine idle speed to the desired value In the closed-loop control mode of this system, the duty cycle for the idle speed control valve is updated at a predetermined time or at a fixed crank angle. The gain used in updating the duty cycle in closed-loop is also fixed This invention represents a method which employs fixed predetermined gain and fixed control valve signal update time However, because of the response delay of the vehicle system, the duty cycle update time and the closed-loop gain are critical for maintaining the stable idling speed If the duty cycle for the idle speed control valve is updated too frequently and/or the closed-loop gain is too large, overadjustment is likely to occur which causes the cycling of the speed of engine revolution. This undesirable engine speed cycling may also result in an engine stall. On the other hand, if the duty cycle is updated too slowly and/or the closed-loop gain is too small, the system may respond inadequately to the engine speed change so that an engine stall may occur when the engine speed is suddenly lowered to a large extent and a speed flare may happen when the load on the engine is greatly reduced. These problems as mentioned above can happen if the closed-loop gain and/or the update time are fixed as in the above-mentioned disclosure.

U.S Pat. No. 4,457,276 discloses an idling speed control system in which the target opening angle of the throttle valve to bring the idle speed towards the desired speed is calculated. The difference between the target throttle valve opening angle and the actual opening angle is used to obtain the duty cycle signal for the bypass passage control valve for the extra intake air. In this system, the desired throttle opening angle is the sum of the base opening angle for the target rpm, a first correction term, and a second correction term. The first correction term is the product of a constant and the engine idling speed deviation. The second correction term is in used when the idling speed is less than a predetermined limit, Nm. It is this second correction term that provides the extra air required to prevent the engine from stalling without causing overshoot. In the proposed system, the extra intake air is increased little by little if the engine speed is lowered to a small extent with respect to the desired idling speed, the extra amount of intake air is increased by a large amount when the actual idling speed of the engine drops significantly below the desired idling speed. The calculation is done once every 30 msec. The '276 disclosure represents a method which varies the control signal according to the idling speed deviation, but uses a fixed update time Thus, the above-mentioned problem is likely to occur. In addition, it only addresses the problem where the idling speed is significantly below the desired speed for stall prevention. The speed flare problem where the idling speed is significantly above the desired speed is not addressed by the '276 patent.

U.S. Pat. No. 4,557,234 discloses an idle speed control system which uses a simplified control device where a bypass passage is either fully opened or blocked. If the idle speed stays within the preset desired range, 630 rpm to 780 rpm, the state of the bypass passage is not changed. If the idle speed stays below 630 rpm for a predetermined period, i.e., $C2 > A$, A is a predetermined value (for example, 32), the bypass passage is opened to increase the engine speed. C2 is incremented by 1 every 32 msec. When the engine speed is lowered to 550 rpm or less, C2 is doubly increased by increments in order to shorten the time period for opening the bypass passage and thus provide a more responsive control. On the other hand, if the engine speed stays above 780 rpm for a predetermined period, i.e., $C1 > B$, B is a Predetermined value (for example, 48), the bypass passage is blocked to reduce the engine speed. C1 is incremented by 1 every 32 msec. Again, to provide a more responsive control, C1 is doubly increased by increments when the engine speed is higher than 950 rpm. Although the time period to update the state of the bypass passage is different for different speed range, it is not truly a function of engine speed deviation. In fact, only four time periods are defined for four different speed ranges. Therefore, the update time may not correspond closely to the desired for all engine speed. In the case of high idling speed, the idling speed will remain high for a long time because of the slow system response. In the case of low idling speed, the system may respond too slow such that the engine stalls.

SUMMARY OF THE INVENTION

A main object of this invention is, therefore, to provide a system and a method for idle speed control in which in the closed-loop control mode, the duty cycle for the air bypass valve is adjusted properly and timely to prevent an engine stall or a speed flare when a significant change in the engine idling speed occurs.

Another object of this invention is to provide an effective idle speed control method which includes open-loop control, closed-loop control and learning control. Open-loop control is carried out when the engine is cold or when the engine operation is not yet stabilized or when the engine is accelerating or decelerating. Closed-loop control is carried out when the engine has warmed up and the engine is idling at steady state condition. Learning condition is carried out when the closed-loop control condition is satisfied, the idling speed is within a predetermined range, the engine coolant temperature is within a predetermined range, and the air-conditioner is turned off. The values for the base duty cycle and the minimum duty cycle are adjusted in the learning control logic. The learned value for the base duty cycle is used in the open-loop control as the reference base duty cycle. The adaptive minimum duty cycle is used as the lower limit for the final duty cycle value in the duty cycle calculation to avoid any abnormal low value.

In accordance with this invention, the idle speed control system is always in effect since the cranking of the engine starts. This invention comprises three engine operation modes: the engine crank mode, the diagnostics mode, and the normal idle speed control mode.

In the engine crank mode, the idle speed control valve is fully opened to aid in starting the engine by setting the duty cycle at 100%. In the diagnostics mode, the idle speed control valve is opened at a fixed position by setting the duty cycle to a preset percent value for diagnostics purposes or when the throttle position sensor fails. The system is set in the normal idle speed control mode if it is not in the crank mode nor in the diagnostics mode. In addition to the above three modes, in case of an engine stall, the idle speed control valve is completely shut off by setting the duty cycle at 0%.

In the normal idle speed control mode, the process is further divided into two mutually exclusive modes: the open-loop control mode and the closed-loop control mode. In order to facilitate the determination of what mode the system should be in to control the idle speed, five idle speed control operation states are identified: dashpot preposition state, dashpot control state, Pre-RPM control state, RPM control state, and RPM lockout protection state. When the throttle position is not effectively closed, the operation state will be in the dashpot preposition state. When the driver releases the acceleration pedal and the throttle position is effectively closed, the dashpot control state will be entered. This state is maintained until the engine speed drops below the desired engine idling speed plus a predetermined threshold and the vehicle speed is below a preset threshold. Then the Pre-RPM control state is entered. When in Pre-RPM control state and the engine speed remains below the desired speed plus a predetermined threshold for a preset time period, for example 2 seconds, the RPM control state is entered. This is a normal idle speed control state. If, when in the Pre-RPM control state, the speed rises above the desired idling speed plus the predetermined threshold, the Dashpot control state will be entered and the above process will be repeated. The RPM lockout protection state is identified if the throttle position is effectively closed and the vehicle speed is below the preset threshold, and the engine speed is rather constant but higher than the desired idling speed plus the predetermined threshold. In the dashpot preposition state and the dashpot control state, the dashpot actuation duty cycle adder is calculated and is used as part of the total duty cycle. This is to add additional air to the fuel mixture to minimize the hydrocarbon emission and also to prevent an engine stall during deceleration.

The open-loop control is carried out when any of the following conditions occurs: 1) the coolant temperature is below a predetermined value, e.g., 150° F.; 2) the time since the engine is started is less than a preset period of time, e.g., 60 seconds; 3) the closed-loop control has never been executed; 4) the idle speed operation state is any of dashpot preposition, dashpot control, or Pre-RPM control. The open-loop control is further divided into two cases, the first case being when any of the above open-loop conditions 1) to 3) are false and condition 4) is true. It is clear that when the engine is cold or the engine is just started or the engine has never entered the closed-loop control since the start of the engine regardless of whether or not the vehicle is at rest and idling, in other words, when the operation of the engine is not yet stabilized, the first case of the open-loop control is carried out; otherwise, when the engine has warmed up and stabilized in closed-loop control if the driver presses the acceleration pedal forcing it to leave the RPM control state, the second case of the open-loop control is carried out. The main purpose of the first case open-loop control is to warm up the engine after its start and thus let it stabilize as soon as possible. The main purpose of the second case open-loop control is to provide a smooth transition from non-idle state to idle state after the acceleration pedal is released by the driver and the vehicle comes to a stop without causing a stall.

In the first case of the open-loop control, the base duty cycle for the bypass valve for the required idling speed is given the larger of the learned base duty cycle and a predetermined base duty cycle for the desired idling speed at sea level. This ensures that there be no problem in starting the engine at any altitude. The duty cycle for this case of the open-loop control is the sum of a base duty cycle, the dashpot duty cycle adder, the duty cycle adder for low temperature compensation, the duty cycle adder for engine-just-start compensation for cold oil viscosity, and other duty cycle adders for additional engine load compensation such as air-conditioner.

On the other hand, in the second case of the open-loop control, which occurs when the engine has warned up and is idling steadily in the closed-loop control while the driver steps on the gas pedal to accelerate, the base duty cycle is the duty cycle at the instant that the control mode changes from the closed-loop to the open-loop. This ensures the smooth transition from the closed-loop control to the open-loop control. When a load is engaged or disengaged while in this second open-loop case, the corresponding compensation term is added to or deducted from the base duty cycle. Since in this second open-loop case the engine has warmed up, there is no need for temperature compensation. Thus, the duty cycle for the second case of the open-loop control is simply the sum of the base duty cycle and the dashpot duty cycle. In the dashpot preposition state, the dashpot actuation duty cycle is proportional to the effective throttle plate opening. Thus, the dashpot duty cycle adder in the dashpot preposition state is nonzero. In the dashpot control state, the dashpot duty cycle adder is gradually decremented to zero in accordance with a function of the dashpot duty cycle itself. This function should be properly calibrated to minimize the hydrocarbon emission and also to prevent engine stall during engine deceleration.

The closed-loop control is carried out when all of the following conditions are satisfied: the engine coolant temperature is greater than or equal to a predetermined value (e.g., 150° F.), the time since the engine is started is greater than or equal to a preset period of time (e.g., 60 seconds), and the idle speed operation state is either RPM control or RPM lockout protection. In the closed-loop control mode, the engine speed is adjusted at the scheduled time by changing the idle speed control valve duty cycle in order to maintain it at the desired idling speed. The change in the duty cycle is proportional to the speed difference between the desired idling speed and the present speed.

In order to control more effectively in the closed-loop mode, the scaling factor or gain for the closed-loop duty cycle change are given different values for different speed regions, for instance, the overspeed region, the underspeed region, and the excessive underspeed region. In the overspeed region, the present engine speed is greater than the desired idling speed. In the underspeed region, the present engine speed is lower than the desired speed and the difference is smaller than a predetermined value. In the excessive underspeed region, the present engine speed is much lower than the desired idling speed such that the difference is greater than or equal to the predetermined value, e.g., 100 rpm. To prevent the engine from stalling when the engine drops far below the desired idling speed, the closed-loop gain for the excessive underspeed is generally greater than those for the underspeed or overspeed situations.

The time to update the duty cycle is also critical. It is desirable that the duty cycle is updated more often if the speed difference is large and less frequently if the speed difference is small. Thus, in the present invention, the duty cycle update time is a function of the speed difference between the present speed and the desired idling speed. If the speed difference is large, because the present speed is either far below or far above the desired idling speed, the time between two updates is made shorter. If the speed difference is small which means that the present speed is very much close to the desired idling speed, it is not necessary to update the duty cycle too often, and therefore, the time between two updates is made longer.

In some situations, it is desired to update the duty cycle to change the engine speed right away, even if it is not the scheduled time to update the duty cycle. One situation is when the engine speed is still decreasing while it has dropped below a predetermined speed lower than the desired idling speed. In this case, the duty cycle has to be updated immediately in order to prevent an engine stall. Another situation is when the engine speed is still increasing while it has risen above a predetermined speed higher than the desired idling speed. In this case, the duty cycle has to be updated right away in order to minimize the speed flare.

It is also desirable that the duty cycle is updated once at the moment when the control changes from the open-loop mode to the closed-loop mode so that the engine speed is adjusted towards the desired idling speed. In addition, when a large load, for example the air-conditioner, is suddenly engaged or disengaged, a corresponding compensation term is added or deducted to prevent a sudden large variation in the idling speed due to a sudden large load change. A robust and fast responding closed-loop idle speed control system is thus achieved by properly selecting the duty cycle update time function, the closed-loop gains for different speed regions, the predetermined values for determining the speed is decreasing while it is already low or the speed is increasing while it is already high, and other related parameters as mentioned above.

The duty cycle calculated in the open-loop control or in the closed-loop control is checked to see if it is larger than the predetermined maximum or if it is smaller than an adaptive minimum, before it is sent to the idle speed control valve. If it is greater than the predetermined maximum, for example 100%, it is set to the maximum to prevent a calculation overflow. If it is smaller than the minimum, it is set to the minimum to avoid any abnormal low value which may cause an engine stall. The minimum duty cycle is made adaptive so that the distance between the learned base duty cycle and the minimum duty cycle is fixed. The adaptive minimum duty cycle is changed in the learning logic which will be described below.

The learning logic is executed when in the closed-loop control mode and all of the following conditions are satisfied: the engine coolant temperature is greater than a predetermined value, say 180° F., and smaller than a predetermined value, say 235° F.; the idle speed operation state is in RPM control; the air-conditioner is turned off; and the engine speed is very close to the desired idling speed, that is, the absolute value of the difference between the actual engine speed and the desired idling speed is less than a predetermined value, for example, 30 rpm. The learned values, which are stored in a keep-alive memory (KAM) which is powered even when the ignition key is turned off, are updated only when the learning conditions as described above are continuously satisfied for a predetermined period of time, e.g., 2 seconds. The learned values include the learned base duty cycle and the adaptive minimum duty cycle.

When the learned value for the base duty cycle in the predetermined period of time is in the average lower than the actual closed-loop duty cycle, then the learned values of both the base duty cycle and the minimum duty cycle are incremented by a preset small amount. On the other hand, if the learned value for the base duty cycle in the predetermined period of time is on the average greater than the actual closed-loop duty cycle, then the learned values of both the base duty cycle and the minimum duty cycle are decremented by a preset small amount. It is clear that the learned value of the base duty cycle is used to record the closed-loop duty cycle when the engine idling speed is very stable and close to the desired idling speed. Since the adaptive minimum duty cycle changes in the same manner as the learned base duty cycle, the distance between the learned base duty cycle and the minimum duty cycle is constant. The main advantage of this is that the control can work effectively at any altitude which may be difficult to achieve if the minimum duty cycle is fixed.

The above and other objects, features and advantages of the invention will be more apparent from the following detailed description in conjunction with the accompanying drawings.

BRIEF DESCRIPTION OF THE DRAWINGS

FIG. 7 is a flowchart illustrating the determination of the closed-loop gain K according to the present invention;

FIG. 8 is a graph showing the relationships between the duty cycle change and the engine speed deviation in the different speed regions according to the present invention;

DESCRIPTION OF THE PREFERRED EMBODIMENT

Figure 1:
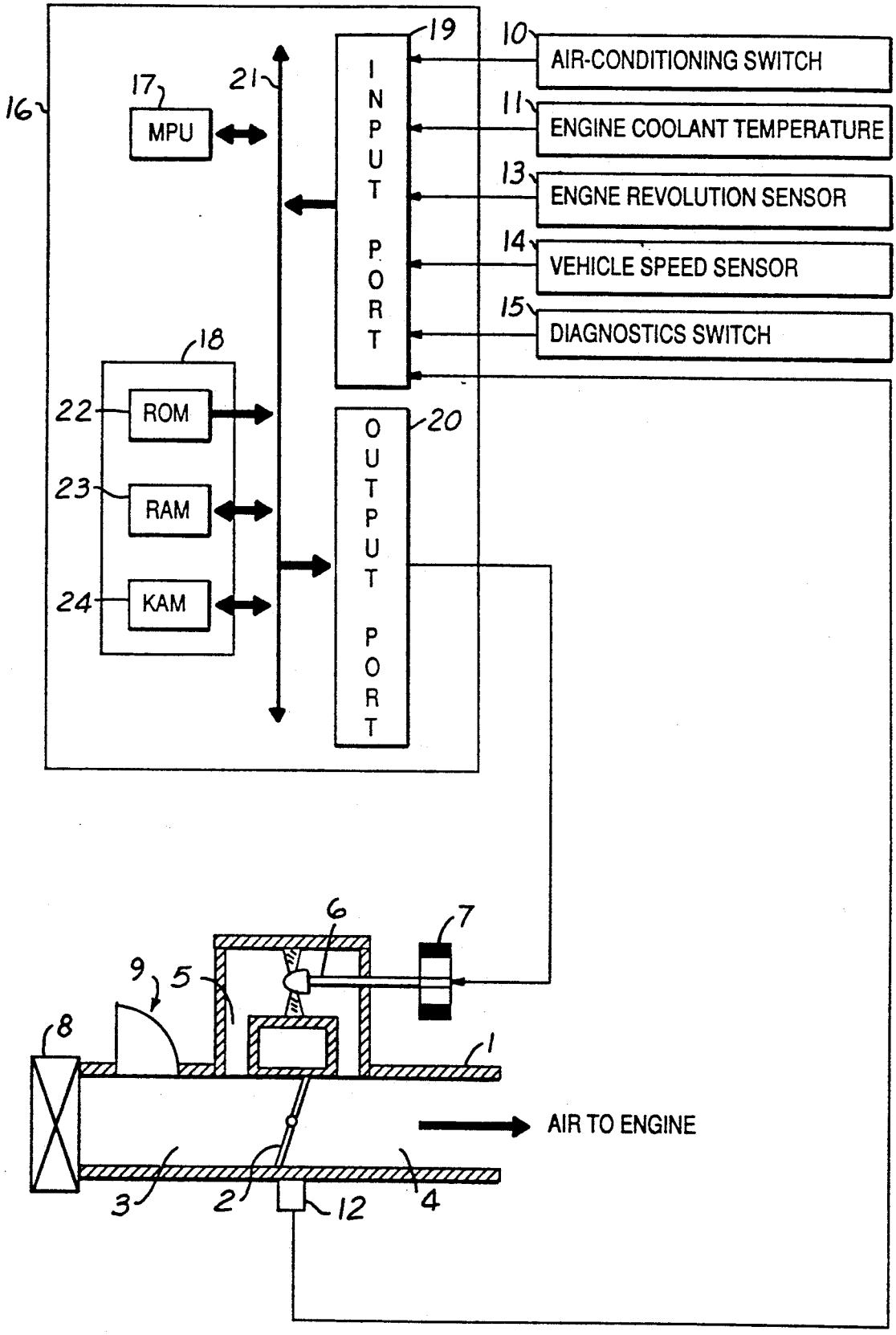
FIG. 1 is a block diagram of the related components of the engine system to which an embodiment of the present invention is applied.

FIG. 1 is a block diagram of a part of an engine system to which an embodiment of the present invention is applied. In FIG. 1, reference numeral 1 denotes the upstream portion of an intake pipe; 2, a throttle valve; 3, an intake passage upstream of the throttle valve; 4, an intake passage downstream of the throttle valve; 5, the air bypass passage which connects portions of the intake passage upstream 3 and downstream 4 of the throttle valve 2; 6, an idle speed control valve installed in the air bypass passage 5; 7, an idle speed control solenoid to which an electric current is applied to control the opening of the idle speed control valve 6 and thus control the flow area of the bypass passage 5; 8 an air filter; 9, an airflow meter for measuring the total flow rate of the intake air sucked into the cylinder; 10, an air-conditioning switch; 11, an engine coolant temperature sensor; 12, a throttle position sensor; 13, an engine revolution sensor; 14, a vehicle speed sensor; 15, a diagnostics switch; 16, a control unit which contains a microprocessor unit MPU 17, a memory unit 18, an input port 19 to which all the sensors and switches mentioned above are connected, an output port 20 which is used to send an electric current to drive the idle speed control solenoid 7, and an internal bus 21 connecting all these components. The memory unit 18 consists of a read-only memory (ROM) 22 for storing the engine control program including the idle speed control routine and the constants, a read-write memory (RAM) 23 for use as counters or timers or as temporary registers for storing data, a keep-alive memory (KAM) 24 for storing learned values. The KAM 24 is always powered even if the ignition key (not shown) is turned off.

The control unit 16 uses all the input signals received from the input port 19 to determine the idle speed operation state and the idle speed control mode, and then calculates the duty cycle of the electric current to be sent to the idle speed control solenoid 7 to control the degree of opening of the idle speed control valve 6. The idle speed control (ISC) routine is a part of the background routine for the engine control which is repeatedly executed.

Figures 2A, 2B:
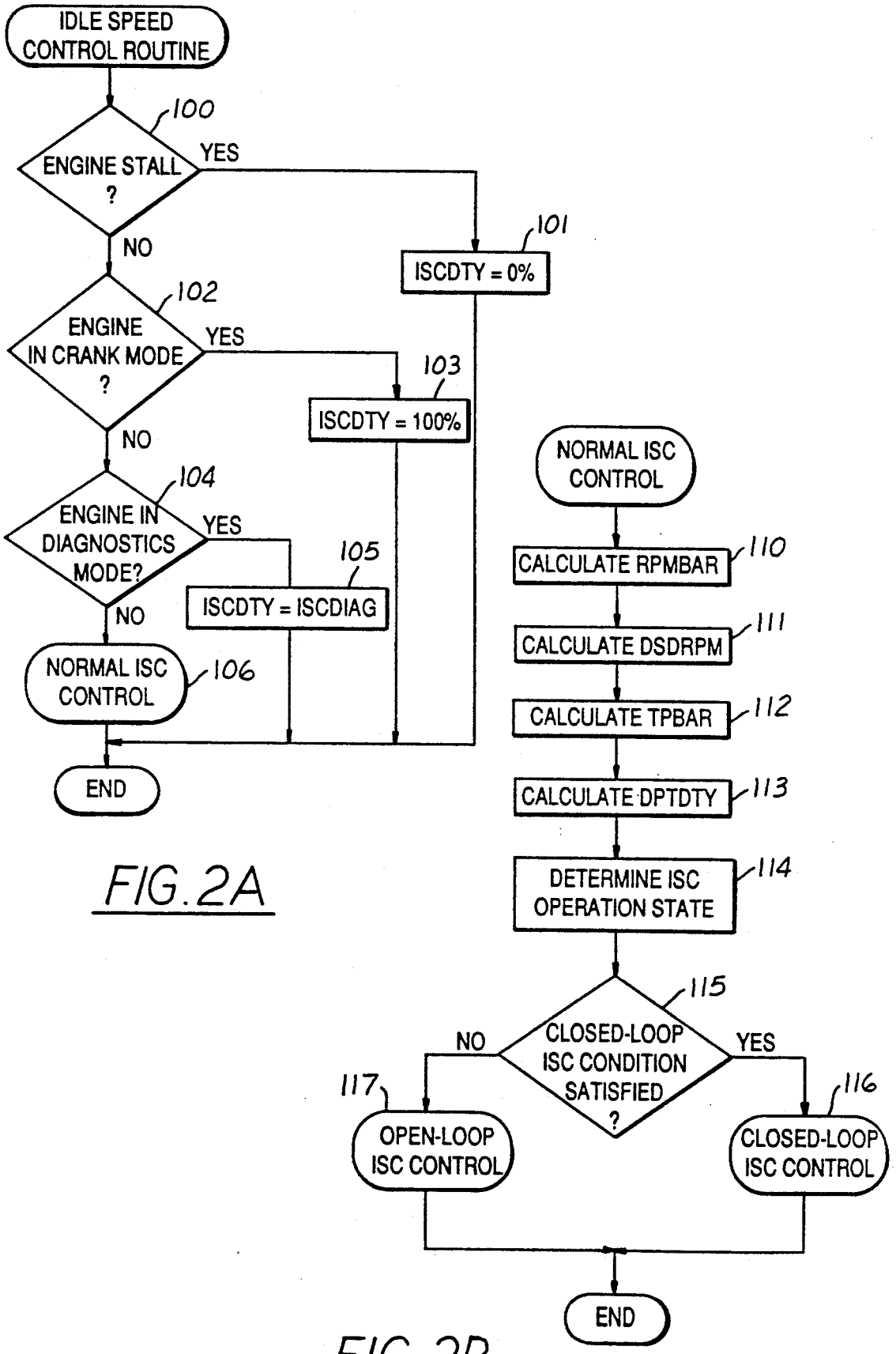
FIG. 2A is a flowchart of the idle speed control routine according to the present invention.
FIG. 2B is a flowchart illustrating the normal idle speed control mode according to the present invention.

FIG. 2A shows the flowchart of the ISC routine. In step 100, it is determined whether or not the engine stalls. If the engine stalls, the ISC air bypass passage 5 is shut off by setting the duty cycle (ISCDTY) for the ISC solenoid 7 to 0% in step 101. Then the ISC routine is terminated. If the engine does not stall, the process proceeds to step 102, where it is determined whether or not the engine is in CRANK mode. If the engine is in CRANK mode, the ISC valve 6 is fully opened in step 103 by setting ISCDTY to 100% to allow more airflow through the bypass passage 5 and aid in starting the engine. Then the ISC routine is terminated. If the engine is not in CRANK mode, the process proceeds from step 102 to step 104, where it is determined whether or not the engine is in DIAGNOSTICS mode by reading the DIAGNOSTICS switch 15. If the switch is set, the engine is in DIAGNOSTICS mode and the ISCDTY is set to a fixed value ISCDIAG in step 105 to allow fixed amount of bypass airflow. Then the ISC routine is terminated. It should be appreciated that the DIAGNOSTICS mode can also be evoked when the throttle position sensor 12 fails as a failure protection mode. If the engine is not in the DIAGNOSTICS mode, it must be in the normal ISC control mode. The process then proceeds to step 106, where the normal ISC control routine is executed. Then, the ISC routine is terminated.

The flowchart for the normal ISC control is shown in FIG. 2B. In the normal ISC control operation, two control modes are identified: the open-loop control mode and the closed-loop control mode. A number of system parameters are used to determine whether the ISC control should be operated in closed-loop control mode or in open-loop control mode. In step 110 to step 113 of FIG. 2B, four parameters are calculated: rolling average of engine speed (PMBAR), desired engine idle speed (DSDRPM), rolling average of throttle position (TPBAR), and ISC duty cycle adder for dashpot action (DPTDTY). RPMBAR is used as the present engine speed and is calculated based on the readings from the engine revolution sensor 13. DSDRPM is used as the desired engine idle speed. It is a sum of a base engine idle speed, a speed adder for compensating for the air-conditioning, a speed adder FN1(ECT) for low engine coolant temperature compensation and a speed adder FN2 (TSSTMR) for engine-just-start compensation to compensate for the friction due to higher viscosity of cold oil. Where, TSSTMR is a timer recording the elapsed time since the engine is started.

Figure 2C:
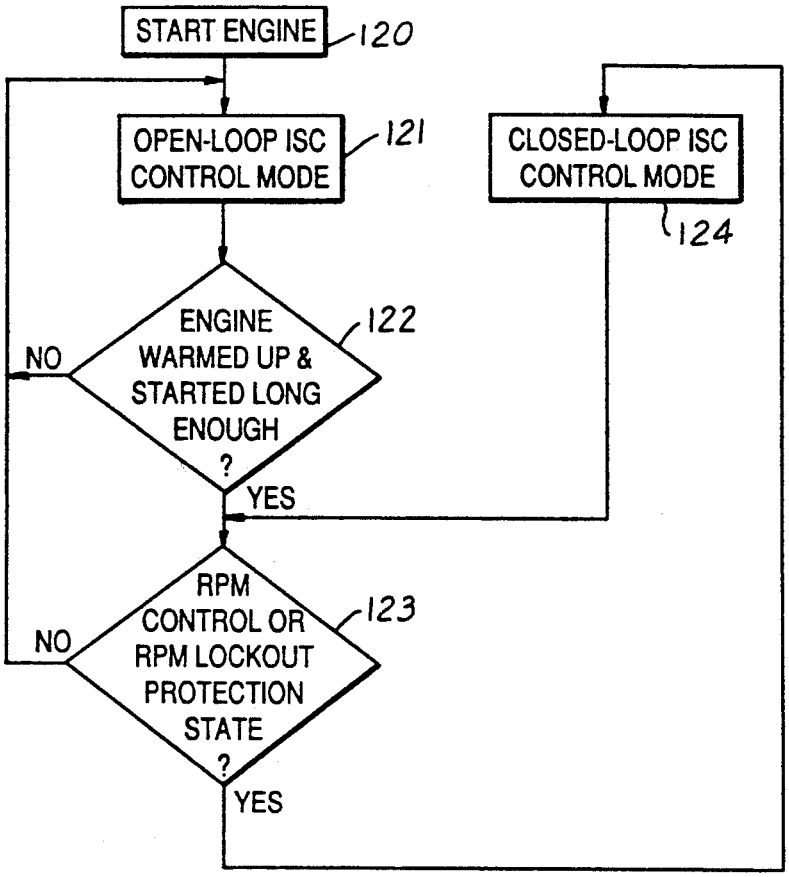
FIG. 2C is a flowchart illustrating the control flow of the open-loop control mode and the closed-loop control mode according to the present invention.
Figure 2D:
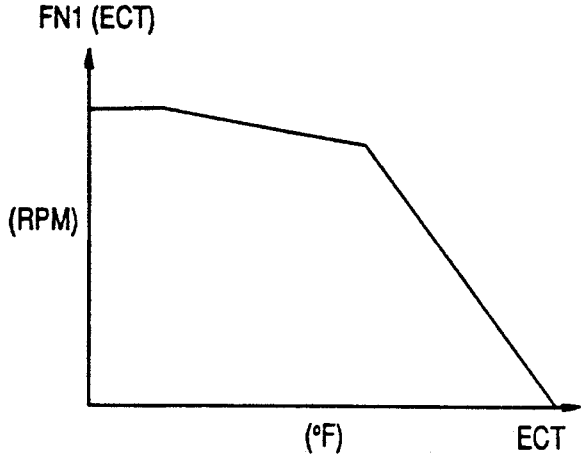
FIGS. 2D and 2E are graphs showing speed functions FN1 and FN2 for the desired idling speed according to the present invention.
Figure 2E:
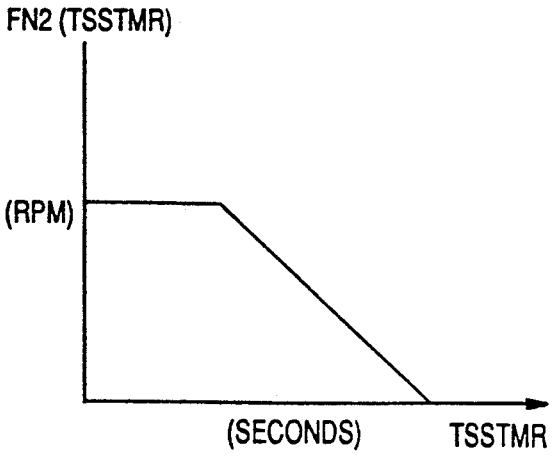

FIGS. 2D and 2E show examples of functions FN1 and FN2. TPBAR is used as the present throttle position and is calculated based on the readings from the throttle position sensor 12. TPBAR is used to determine whether the engine is in closed throttle or not and to determine the dashpot duty cycle DPTDTY. DPTDTY is used as the ISC duty cycle adder for dashpot actuation during acceleration and deceleration in order to reduce hydrocarbon emission and/or deceleration stalls. When the throttle valve is not completely closed, DPTDTY is a function of TPBAR as shown below, $$DPTDTY = OFFSET + DPTK*(TPBAR - TPMIN) \quad (1)$$

where,

OFFSET = An offset value for dashpot duty cycle

DPTK = A dashpot duty cycle scaling factor

Figure 3A:
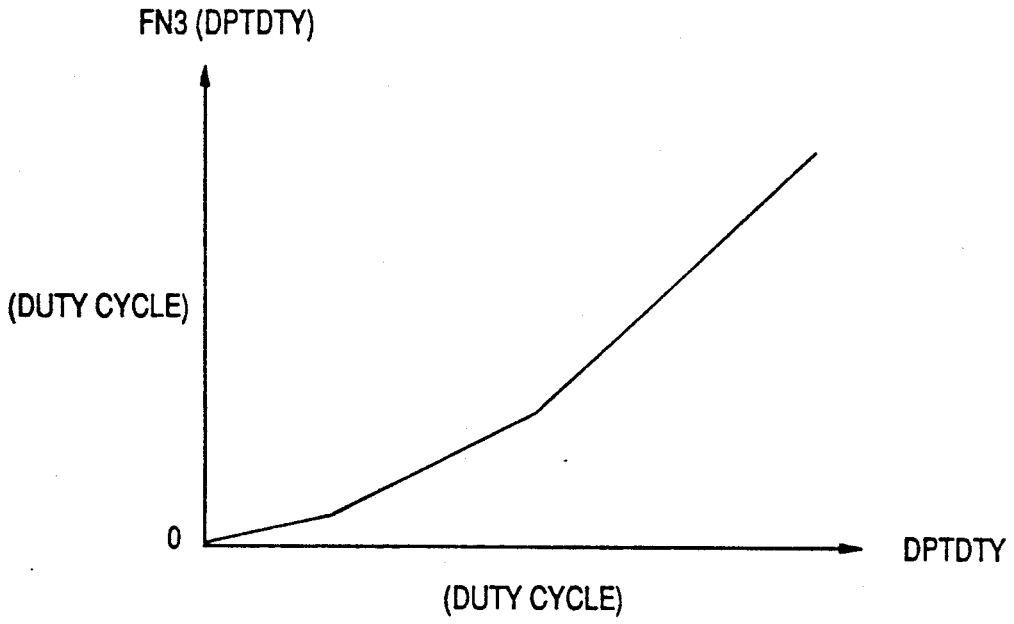
FIG. 3A is a graph showing an example of function FN3 according to an embodiment of the present invention.
Figure 3B:
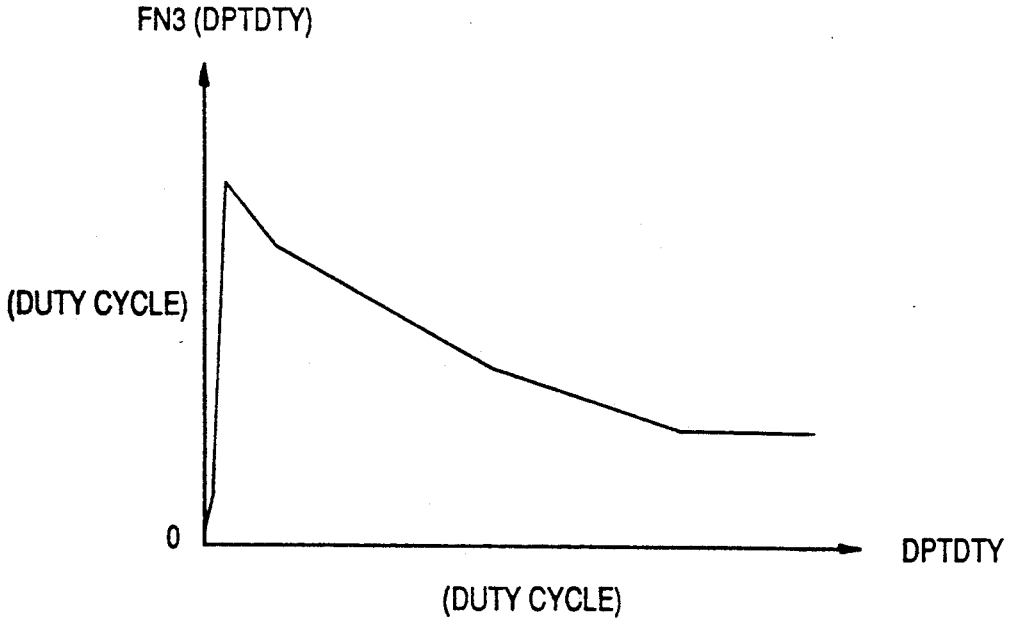
FIG. 3B is a graph showing another example of function FN3 according to the present invention.

TPMIN = The minimum throttle position at all time when the throttle valve is effectively closed In closed throttle and during engine deceleration, DPTDTY is gradually decremented to zero as shown below $$DPTDTY = DPTDTY - FN3(DPTDTY) \quad (2)$$

where, FN3(DPTDTY), dashpot decrement function, is a function of DPTDTY. FN3 has to be properly calibrated to obtain the desired dashpot actuation profile and meet emission standards. FIGS. 3A and 3B show two examples of function FN3. In FIG. 3A, DPTDTY decreases faster at high DPTDTY values; while, in FIG. 3B, DPTDTY decrease faster at low DPTDTY values.

Referring again to FIG. 2B, after the four system parameters as mentioned above are calculated, the process proceeds to step 114, to determine the idle speed control operation state. In this embodiment, the ISC operation states are divided into five categories: 1) the dashpot preposition state, 2) the dashpot control state, 3) the Pre-RPM control state, 4) the RPM lockout protection state, and 5) the RPM control state.

The dashpot preposition and the dashpot control states are used for dashpot action mainly to improve emission control during deceleration and to prevent the engine from deceleration stall. The dashpot preposition state is entered when the engine is in normal run mode and when the throttle valve is not completely closed. Therefore, in the dashpot preposition state, the engine speed is either increasing or high. The purpose of this dashpot preposition state is in anticipation of an engine speed deceleration. In this state, according to EQU. (1), DPTDTY will be nonzero, which is an adder for the final ISCDTY. The dashpot control state is entered when the throttle position sensor just senses the closed throttle when the driver releases the acceleration pedal and the engine begins to decelerate. In the beginning of this state, the dashpot duty cycle adder DPTDTY has a nonzero value when the dashpot control state is just entered. Afterwards, this value is gradually decremented to zero according to EQU. (2). As mentioned earlier, the dashpot decrement function FN3 has to be properly calibrated in order to minimize hydrocarbon emission and meet emission standards.

The dashpot control state is retained until DPTDTY becomes zero, and the vehicle speed sensed from the vehicle speed sensor 14 falls below a predetermined small value VSMIN, for example 0.5 mile/hr., and the engine speed is smaller than the desired engine speed plus a first predetermined offset speed RPM1, for example 100 rpm. In this case, the Pre-RPM control state is entered. If the engine speed remains smaller than the desired engine speed plus the first predetermined offset speed RPM1 for a predetermined period of time TM, for example 1 second, the control will transfer to the RPM control state. On the other hand, if the engine speed goes higher than the desired idling speed plus the first predetermined offset speed but lower than the desired idling speed plus a second predetermined offset speed RPM2, for example 250 rpm, during the predetermined period of time, the control state is transferred to the RPM lockout protection state, which will be discussed later. The second predetermined offset speed is greater than the first predetermined offset speed. If after the predetermined period of time the engine speed goes higher than the desired idling speed plus the second predetermined offset speed, the control transfers to the dashpot control state. Thus, to be in the RPM control state, the following conditions have to be satisfied: the throttle valve is closed, DPTDTY is zero, the vehicle speed is either none or very low, and the engine speed has been less than the desired idle speed plus the first predetermined offset speed RPM1 for a predetermined period of time TM. The ISC control operation state stays in the RPM control state once it is entered, unless the dashpot preposition state is reentered by changing the throttle plate position out of the closed throttle position.

The RPM control state is a normal engine idling state, in which the engine idling speed is controlled to be very close to the desired speed by adjusting the ISC valve based on the difference between the desired engine speed and the actual engine speed, as long as the closed-loop control conditions are satisfied. The RPM lockout protection state is entered when all the conditions for the RPM control state are satisfied except the engine speed is almost constant but is greater than the desired engine idle speed plus the first predetermined offset RPM1 and is less than the desired engine idle speed plus the second predetermined offset RPM2. One case that the RPM lockout protection state can be entered is when the ISC adaptive learning cell has a large value due to improper initialization or corruption by noise. Since this state is entered from the dashpot control state when the engine idle speed control is in open-loop control mode, the engine will be locked in a high idling speed and will not be able to enter the normal RPM control state. Thus, when in this state, to prevent the engine from being locked in the high idling speed, the engine idle speed is controlled in the same manner as in the RPM control state so that the engine idling speed can come down to close to the desired speed.

After the determination of the ISC state, the process proceeds to step 115, where the ISC control mode is determined. If the closed-loop ISC control mode condition is satisfied, the ISC closed-loop control routine is executed in step 116; otherwise, the process proceeds to step 117, where the ISC open-loop control routing is executed. Then the normal ISC control routine is terminated. In this embodiment, although not shown in FIG. 2B, in the beginning of the normal ISC control routine, the air-conditioner switch 10 is read. If the air-conditioner switch is ON, a flag ACCFLG is set to 1; otherwise, it is set to 0. In the end of the normal ISC control routine, flag ACCLST, which is to record the previous air-conditioner switch position, is set equal to ACCFLG. Thus, by comparing ACCFLG and ACCLST, it is known whether the air-conditioner switch position has changed.

The open-loop control is carried out when any of the following conditions occurs: 1) the coolant temperature ECT sensed from the ECT sensor 11 is below a predetermined value ECTHR, e.g., 150° F.; 2) the time since the engine is started (TSSTMR) is less than a preset period of time TSSTHR, e.g., 60 seconds; 3) the closed-loop control has never been executed; 4) the idle speed operation state is any of dashpot preposition, dashpot control, or Pre-RPM control. The open-loop control is further divided into two cases, the first case being when any of the above open-loop conditions 1) to 3) is satisfied, while, the second case being when all of the open-loop conditions 1) to 3) are false and condition 4) is true. It is clear that when the engine is cold or the engine is just started or the engine has never entered the closed-loop control since the start of the engine regardless of whether or not the vehicle is at rest and idling, in other words, when the operation of the engine is not yet stabilized, the first case of the open-loop control is carried out; otherwise, when the engine has warned up and stabilized in closed-loop control if the driver presses the acceleration pedal forcing it to leave the RPM control state, the second case of the open-loop control is carried out.

The main purpose of the first case open-loop control is to warn up the engine after its start and thus let it stabilize as soon as possible, while the main purpose of the second case open-loop control is to provide a smooth transition from non-idle state to idle state after the acceleration pedal is released by the driver and the vehicle comes to a stop without causing a stall. On the other hand, the closed-loop ISC control condition is satisfied if all of the following conditions are true: in the RPM control state or in the RPM lockout protection state, the engine coolant temperature is greater than the threshold ECTHR, and the time since the engine is started (TSSTMR) is greater than the threshold TSSTHR. These conditions simply say that when the engine is just started or is not warmed up enough, or when ISC control state is not in RPM control or RPM lockout protection, put the engine under open-loop ISC control mode. And, only when the engine has warmed up and the ISC control state is in either RPM control or RPM lockout protection state, which indicates that the engine is idling steadily, the normal closed-loop ISC control mode is entered. In step 115, in addition to determining the ISC control mode, three flags are set or cleared (not shown): CLOSED_LAST flag, OPEN_LAST flag, and CLSFLG flag. Flag CLOSED_LAST is set when the Previous ISC control mode is closed-loop, it is cleared otherwise. Flag OPEN_LAST is set when the previous control mode is open-loop, it is cleared otherwise. Flag CLSFLG is set, whenever the closed-loop control is carried out.

FIG. 2C shows the ISC control mode status flow after the engine is started and running. The ISC control mode is set in open-loop control mode as shown in step 121 after the engine is started in step 120. Then the engine coolant temperature and the time since the engine is started are checked in every background loop as shown in step 122. If the engine is not warmed up yet or the time since the engine is started is short, the ISC control remains in the open-loop mode. This continues until the engine has been started for a while and the engine has warmed up, then the ISC operation state is checked in every background loop as shown in step 123. If the ISC operation state is neither the RPM control state nor the RPM lockout protection state, the ISC control remains in the open-loop mode. Otherwise, the ISC control enters the closed-loop mode as shown in step 124. Thereafter, as long as the ISC operation state remains in either the RPM control or the RPM lockout protection state, the ISC control mode remains in the closed-loop mode. If the ISC operation state is changed from the RPM control state to the dashpot preposition state, which occurs when the driver steps on the acceleration pedal, the ISC control mode will be changed to open-loop mode.

Figure 4A:
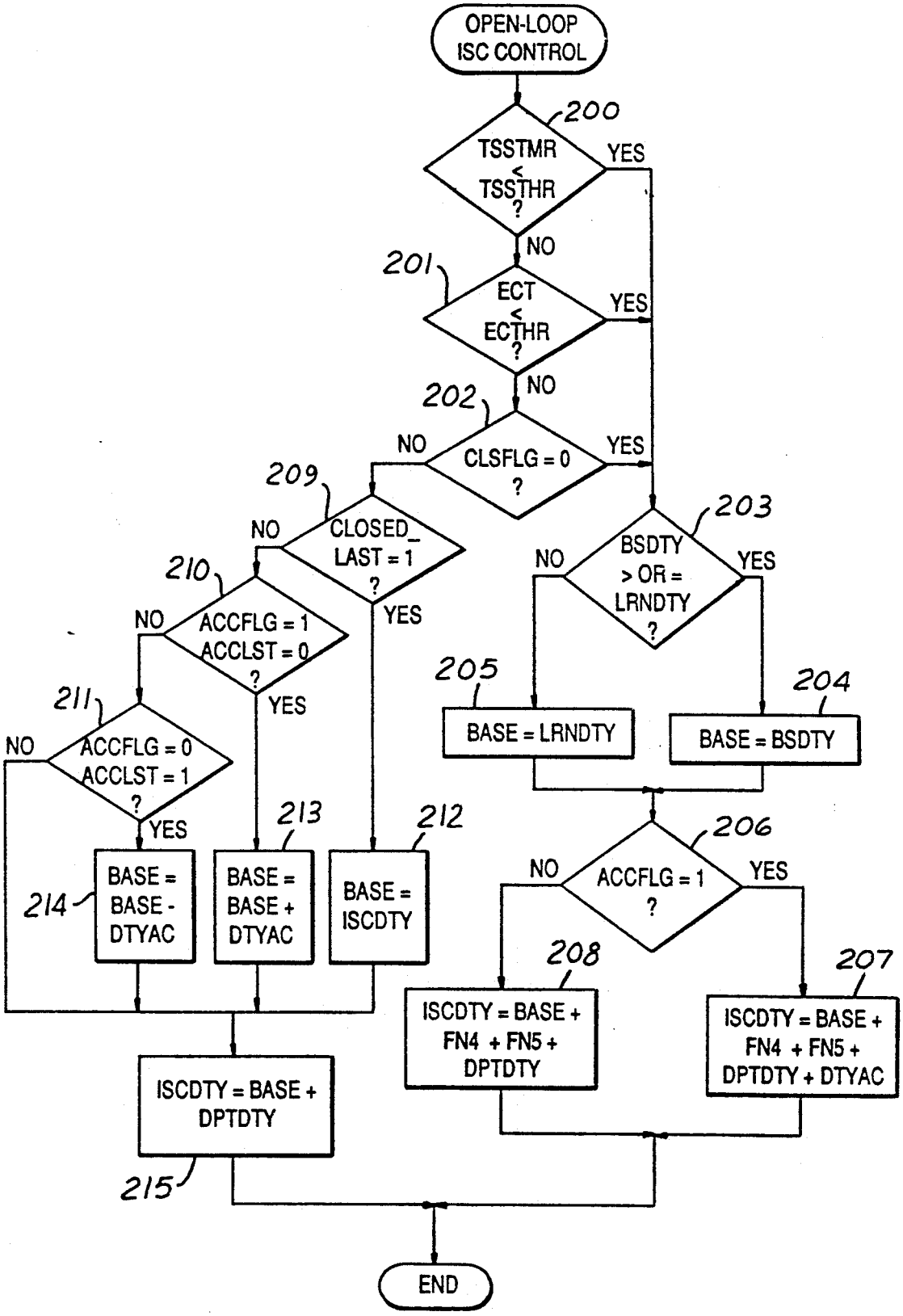
FIG. 4A is a flowchart illustrating the open-loop control according to the present invention.

FIG. 4A shows the open-loop ISC control routine flowchart. Steps 200 to 202 are used to determine whether to use the first case open-loop control or to use the second case open-loop control Steps 203 to 208 are the steps to carry out the first case open-loop control. While, steps 209 to 215 are the steps used in carrying out the second case open-loop control. In step 200, the time since the engine is started (TSSTMR) is checked to see if it is less than a predetermined value TSSTHR, say 60 seconds; in step 201, the engine coolant temperature (ECT) is checked to see if it is less than a predetermined value ECTHR, say 150° F.; in step 202, it checks if the system has never entered the closed-loop control before it entered the open-loop control by checking whether the flag CLSFLG is cleared or not. If any of steps 200 to 202 is true, the process proceeds to step 203 to begin carrying out the first case open-loop control; if otherwise, all of the steps 200 to 202 are false, the process proceeds to step 209 to start carrying out the second case open-loop control.

In step 203, the predetermined open-loop base ISC duty cycle (BSDTY) is compared with the learned base ISC duty cycle (LRNDTY). BSDTY is determined at sea level by letting the engine idling in the first case open-loop mode with air-conditioning switch 10 off and adjusting the ISC valve duty cycle until the desired idling engine speed is obtained. If the base value is greater than or equal to the learned value, then the base value BASE for the open-loop ISC duty cycle is set equal to BSDTY, as shown in step 204. Otherwise, the base value BASE is set equal to LRNDTY, as shown in step 205. By using the larger of the predetermined value and the learned value, it is least likely to have problems in starting the engine at any altitude.

Figure 4B:
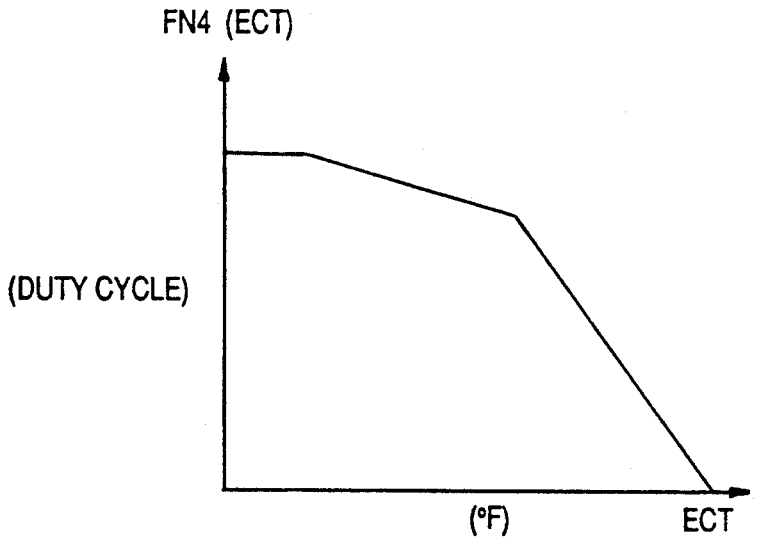
FIGS. 4B and 4C are graphs showing the duty cycle adder functions FN4 and FN5 according to the present invention.
Figure 4C:
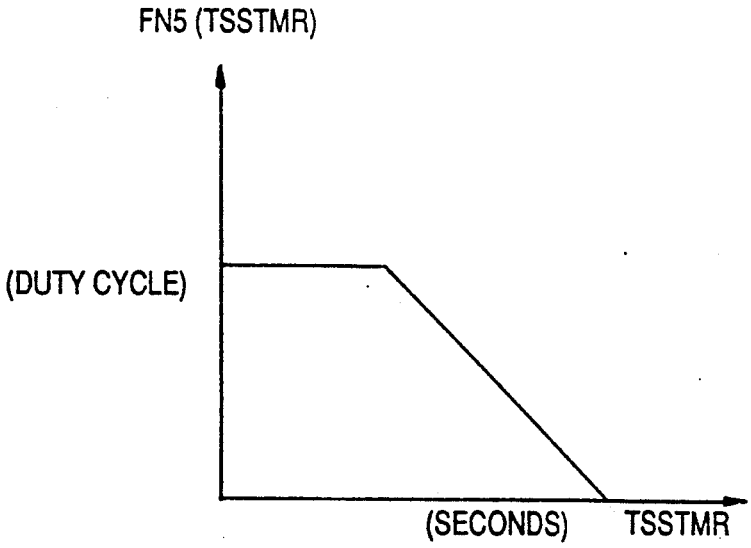

Then the process proceeds to step 206, where the present air-conditioner switch position is checked by checking a flag ACCFLG, which is set when the air-conditioner switch is ON and cleared, otherwise. If the air-conditioner is ON, the process proceeds to step 207 to calculate the final duty cycle ISCDTY, which is the sum of the base duty cycle base, the duty cycle for engine coolant temperature compensation FN4 (ECT), the duty cycle adder for time-since-engine-start compensation FN5(TSSTMR), the dashpot duty cycle adder DPTDTY, and the duty cycle adder for the air-conditioning compensation DTYAC. Examples of functions FN4 and FN5 are shown in FIGS. 4B and 4C. They should be set to obtain the required engine speed addition as set by functions FN1 and FN2, respectively. If the air-conditioner is OFF, the process proceeds to step 208, where the final duty cycle ISCDTY is calculated which is the same as step 207 except that it does not require the air-conditioning compensation term DTYAC.

In step 209, it is checked whether the last ISC control mode is closed-loop control or not by checking whether flag CLOSED_LAST is set or not. If the answer is yes, the process proceeds to step 212, where the base duty cycle BASE is set equal to the last duty cycle ISCDTY, which is the duty cycle at the moment the control transfers from closed-loop to open-loop. And then, step 215 is executed to calculate the final duty cycle for the bypass valve which is the sum of BASE and the dashpot duty cycle adder. If the answer in step 209 is no, the process proceeds to step 210 to see whether the air-conditioner switch has changed from OFF to ON. If the answer is yes, the base duty cycle BASE is incremented by DTYAC in step 213 to compensate for the air-conditioning load. And then the process proceeds to step 215 to obtain the final duty cycle. If the answer in step 210 is no, the process proceeds to step 211 to see whether or not the air-conditioner switch has changed from ON to OFF. If the answer is yes, the base duty cycle BASE is decremented by DTYAC since the air-conditioning load compensation is not needed. And then the process proceeds to step 215 to obtain the final duty cycle. If the answer in step 211 is no, then the air-conditioning load has not changed, the base duty cycle BASE remains unchanged. And the process proceeds directly to step 215 to obtain the final duty cycle.

From the above description, it is clear that when the control exits the closed-loop and enters the case-2 open-loop control, the duty cycle at the moment is recorded and used as the base duty cycle. From then on until the closed-loop control is re-entered, if the air-conditioning switch position is not changed during that period, the original duty cycle will be used as the initial duty cycle when the control re-enters the closed-loop. Therefore, the transition from the closed-loop control to the open-loop control and vice versa are smooth, as in most cases, the operating condition in closed-loop control remains rather constant. In addition, if the air-conditioner switch position has changed, the idling speed can be kept steady when the control returns the closed-loop since the duty cycle is immediately adjusted to reflect the load change.

Figure 5:
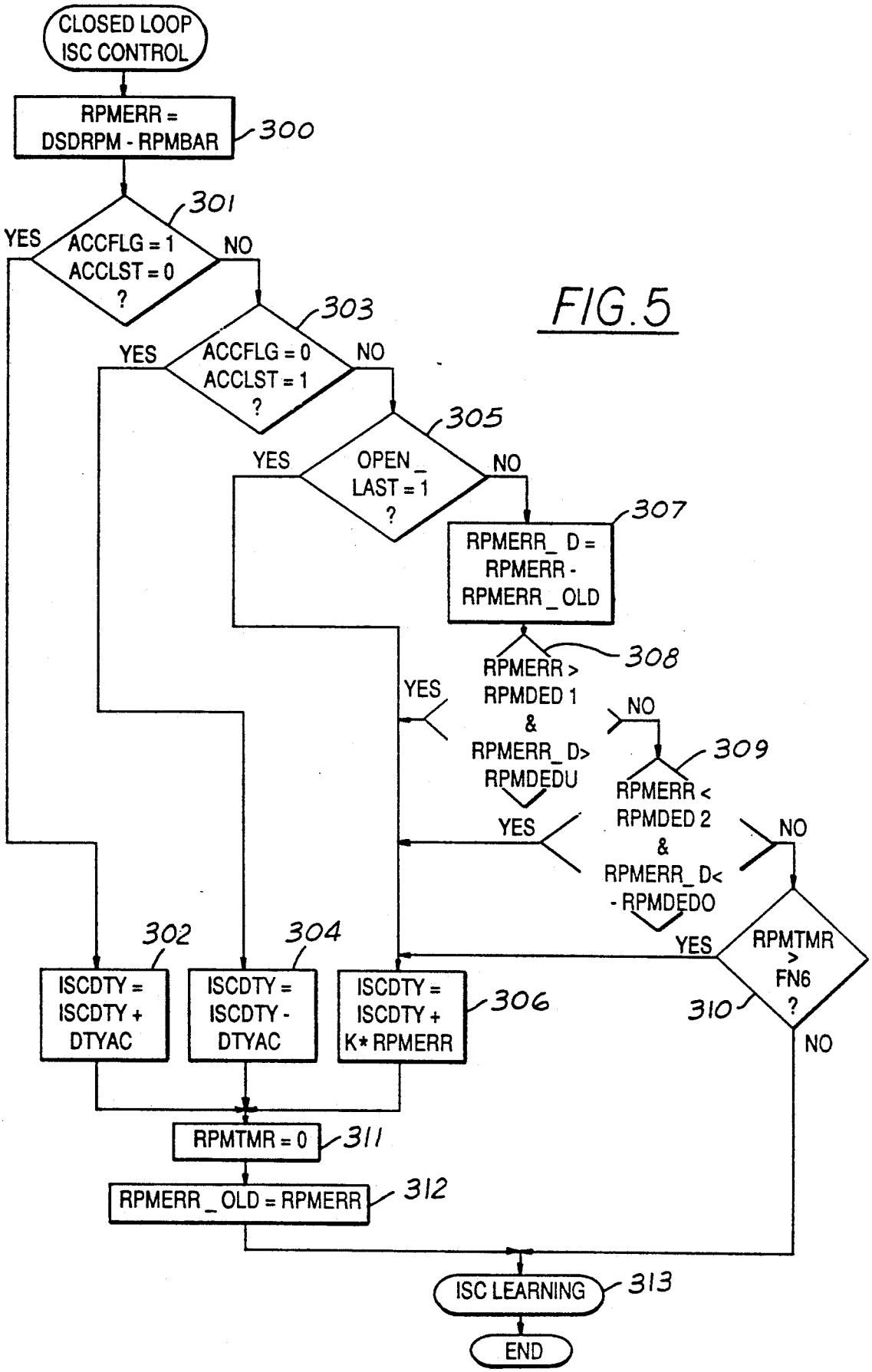
FIG. 5 is a flowchart illustrating the closed-loop control according to an embodiment of the present invention.

FIG. 5 shows the flowchart for the closed-loop ISC control routine. In step 300, the engine speed deviation (RPMERR) of the present engine speed (RPMBAR) from the desired engine idle speed (DSDRPM) is calculated as below, $$RPMERR = DSDRPM - RPMBAR \quad (3)$$

Note that when the present engine idle speed (RPMBAR) is greater than the desired engine idle speed (DSDRPM), which is an overspeed situation, RPMMERR will have a negative value; on the other hand, if the engine idle speed is less than the desired engine speed, which is an underspeed situation, RPMERR will be positive.

In step 301, it is checked to see whether the air-conditioner switch position has changed from OFF to ON. If the answer is yes, the process proceeds to step 302, where the duty cycle for the bypass passage control valve is incremented by DTYAC. By providing extra air immediately when the air-conditioning load is engaged on the engine, it is possible to prevent the engine speed from dropping too much and abruptly which may cause a rough feeling or even an engine stall. Then the process proceeds to step 311, where the engine speed update timer RPMTMR is reset to 0. RPMTMR is a real-time timer which continuously counts up until reaching the maximum. Then in step 312, the current engine speed deviation (RPMERR) is recorded as the previous engine speed deviation (RPMERR_OLD). The process then proceeds to step 313, where ISC learning routine is executed. The learning control will be described later. After the ISC learning, the closed-loop ISC control routine is terminated.

If the answer in step 301 is no, the process proceeds to step 303 to check whether the air-conditioner switch has changed from ON to OFF. If the answer is yes, the duty cycle is decremented by DTYAC in step 304. By reducing the bypass air immediately when the air-conditioning load is released, the engine speed flare can be prevented. After step 304 is carried out, the process proceeds to step 311, followed by step 312 and step 313. If the answer in step 303 is no, the process proceeds to step 305 to check if the previous ISC control mode is open-loop by checking whether flag OPEN_LAST is set or not. If the answer is yes, the process proceeds to step 306 to update the ISCDTY immediately which will be described later; otherwise, the process proceeds to step 307, where the engine speed deviation difference (RPMERR_D) is calculated as below, $$RPMERR_D = RPMERR - RPMERR_OLD \quad (4)$$

where, RPMERR_OLD is the RPMERR when ISCDTY is last update. RPMERR_D is used to determine whether or not the engine speed keeps increasing or decreasing. In step 305, the engine idling speed is checked. If RPMERR is greater than a threshold RPMDED1, say 60 rpm, the RPMERR_D is greater than a threshold RPMDEDU, say 30 rpm, which implies the engine speed is still decreasing while it is below the desired idle speed, ISC duty cycle is updated to increase the engine idling speed in step 306; otherwise, the process proceeds to step 303, where the engine speed is checked. If RPMERR is less than a threshold −RPMDED2, say −60 rpm, and RPMERR_D is less than a threshold −RPMDEDO, say −30 rpm, which implies the engine speed is still increasing while it is above the desired idle speed, ISC duty cycle is updated to decrease the engine idling speed in step 306; otherwise, the process proceeds to step 310, where the RPM update timer (RPMTMR) is checked. If the timer is greater than a function value FN6(RPMERR_OLD), then it is time to update the ISC duty cycle and the process proceeds to step 306; otherwise, the process proceeds to step 313, where the ISC learning logic is executed.

Figure 6:
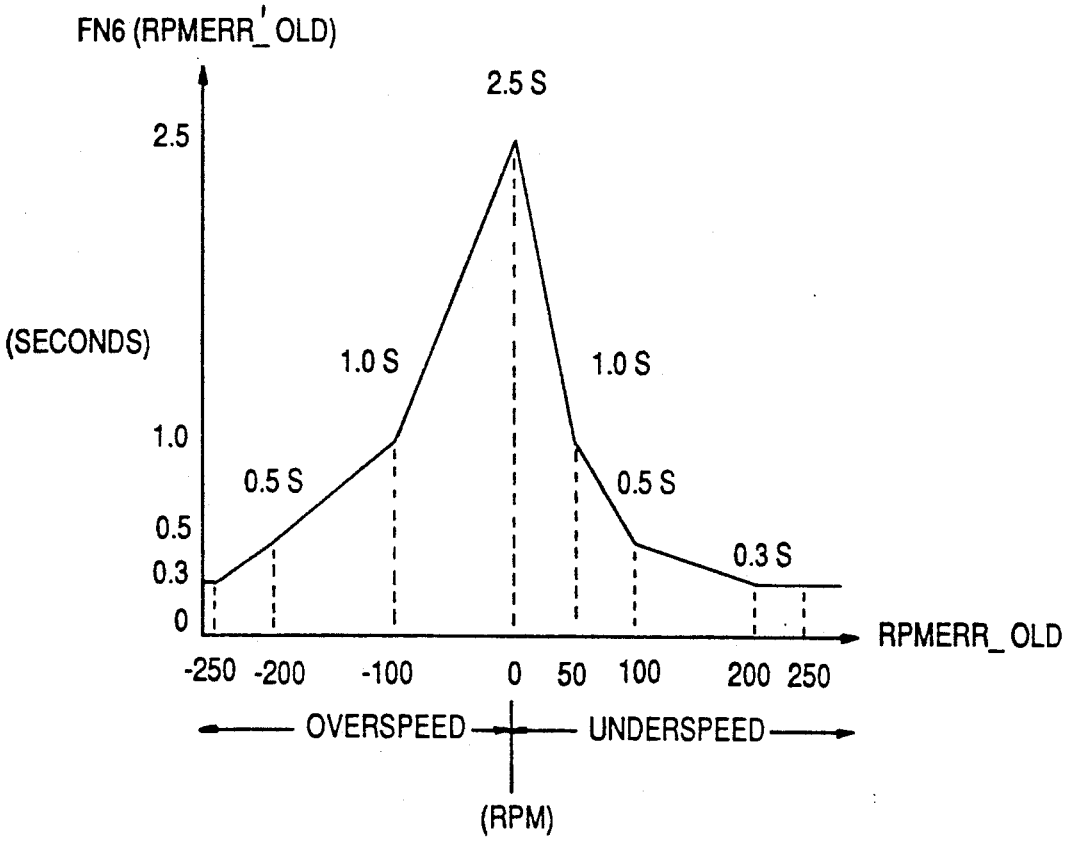
FIG. 6 is a graph illustrating the duty cycle update time function FN6 in accordance with an embodiment of the invention.

Function FN6 is a function of RPMERR_OLD. FIG. 6 shows an example of function FN6. It is selected such that when the absolute value of RPMERR_OLD is small, the function value for FN6 is large, and vice versa. This is because when the engine speed deviation is small, there is no need to update the ISC duty cycle too frequently; however, if the present engine speed deviates from the desired speed too far, it is desired to update the ISC duty cycle to bring it close to the desired engine speed rapidly. By carefully selecting values from the above mentioned thresholds, i.e., RPMDED1, RPMDED2, RPMDEDU, and RPMDEDO in combination with a carefully selected function FN6, a robust closed-loop ISC control system is achieved. This system not only prevents the engine speed from oscillating or even stalling, but also responds quickly to the large deviation of the engine speed from the desired idle speed to bring the engine speed back to the desired idle speed.

In step 306, the ISC duty cycle is calculated as below, $$ISCDTY = ISCDTY + K*RPMERR \quad (5)$$

where, K is the closed-loop ISC gain or scaling factor. It is always positive and is a function of RPMERR. In this embodiment, for the purpose of determining the proper values for K. three engine speed regions are identified: overspeed, underspeed, and excessive underspeed. FIG. 7 shows the flow chart for determining the values for K. In step 400, it is determined whether or not the engine speed is excessively under the desired idle speed by checking if RPMERR is greater than or equal to a threshold RPMBRK (say 100 RPM). If the answer is yes, K is set equal to the excessive-underspeed gain value KEU in step 401; otherwise, the process proceeds to step 402, where it is determined whether or not the engine speed is under the desired idle speed by checking if RPMERR is greater than or equal to 0.

If it is an underspeed condition, K is set equal to the underspeed gain KU in step 403. Otherwise, it is an overspeed condition, K is thus set equal to the overspeed gain KO in step 404. Note that under underspeed conditions K*RPMERR is a positive term which increases ISCDTY to increase the bypass airflow so that engine speed increases towards the desired idle speed;

on the other hand, for overspeed condition K*RPMERR is a negative term which decreases ISCDTY so that engine speed decreases towards the desired idle speed. It is one of the objectives of this invention to make the system respond faster when the engine speed drops far below the desired engine speed in order to avoid engine stalling. Therefore, KEU is generally selected to be greater than either KU or KO, while KO and KU are generally selected to be very close to each other.

FIG. 8 illustrates the relationship between K*RPMERR and RPMERR for different engine speed regions. Note that in FIG. 8, KEU is selected to be greater than both KU and KO, and KO is selected to be greater than KU. In general, KO, KU, and KEU have to be carefully selected together with other parameters, for instance, RPMDED1, RPMDED2, RPMDEDU, RPMDEDO, and function FN6, in order to obtain a fast responding and yet stable idle speed control system.

Although it is not shown in either FIG. 4A or FIG. 5, the final ISC duty cycle ISCDTY is checked to see if it is larger than a predetermined maximum or if it is smaller than an adaptive minimum, before it is sent to control the idle speed control valve. If it is greater than a predetermined maximum, say 100%, it is set to the maximum to avoid calculation overflow problem. If it is smaller than the minimum, it is set to the minimum value to avoid any abnormal low value which may cause an engine stall. In this invention, the minimum duty cycle is made adaptive so that the distance between the learned base duty cycle and the minimum duty cycle is fixed. The advantage of this is that the control can work effectively at any altitude which may be difficult to achieve if the minimum duty cycle is fixed. The adaptive minimum duty cycle is changed in the learning logic to be described below.

Figure 9:
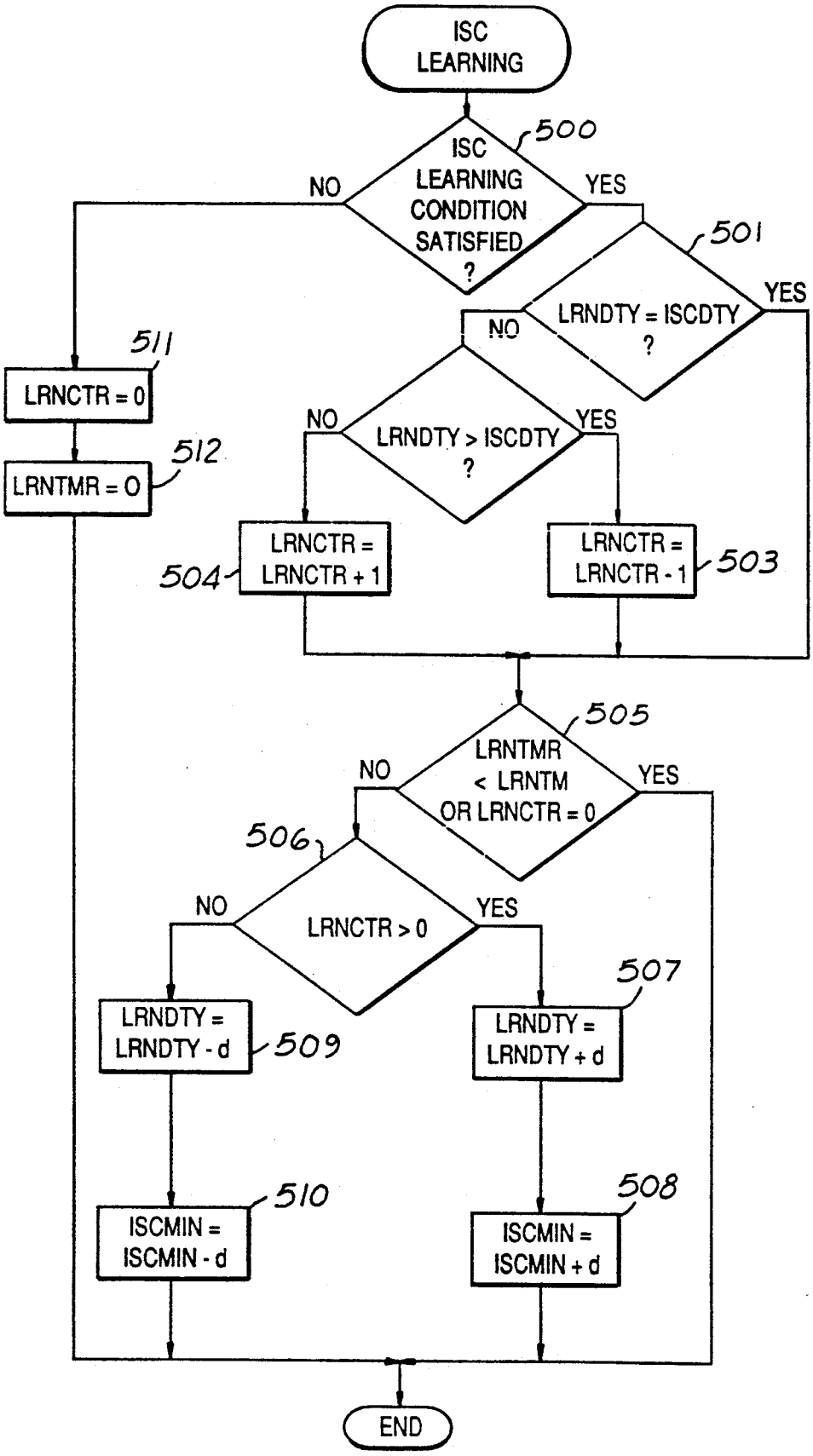
FIG. 9 is a flowchart illustrating the idle speed learning logic according to an embodiment of the present invention.

FIG. 9 shows the flowchart for the ISC learning routine. The purposes of the learning routine are to learn the required ISC duty cycle LRNDTY for the desired idling speed and to update the minimum ISC duty cycle ISCMIN. This is done by updating the learning cell LRNDTY in KAM 24 in such a way that it keeps track of the ISCDTY value when the engine is running in the closed-loop ISC control mode and the engine speed is very stable and close to the desired engine idle speed. In addition, the minimum duty cycle ISCMIN is updated in the same manner as LRNDTY so that the difference between LRNDTY and ISCMIN is always the same. The learned value LRNDTY is then used as a reference for the base duty cycle in the first case open-loop control mode, as described before. Referring back to FIG. 9, in step 500, the ISC learning condition is examined. In this embodiment, the ISC learning condition is satisfied when the following conditions are all true: in the RPM control state, air-conditioning switch 10 is off, the engine coolant temperature is less than a predetermined large value ECTHRH (say, 235° F.) and greater than a predetermined small value ECTHRL (say, 180° F.), and the absolute value of the engine speed deviation RPMERR is less than a predetermined threshold RPMDED (say 30 RPM). These learning conditions imply that ISC learning is only allowed when the engine idling speed is rather stabilized and the engine coolant temperature is within normal range.

If the learning condition is not satisfied, the learning counter LRNCTR and the learning timer LRNTMR are reset to 0 in steps 511 and 512, then the learning routine is exited. LRNTMR is a real-time timer which continuously counts up until reaching the maximum. If the learning condition is satisfied, the current ISC duty cycle ISCDTY is compared to the learning duty cycle LRNDTY in step 501. If ISCDTY is equal to LRNDTY, the process proceeds to step 505; otherwise, it is checked in step 502 that whether or not LRNDTY is greater than ISCDTY. If LRNDTY is greater than ISCDTY, LRNCTR is decremented by 1 in step 503; otherwise, LRNCTR is incremented by 1 in step 504.

In step 505, it is checked whether it is time to update the adaptive learning base duty cycle cell LRNDTY. If the learning timer is less than a threshold LRNTM (say 2 seconds) or LRNCTR is equal to 0, then it is not time to update the ISC learning cell, the learning routine is thus ended. Otherwise, it is time to update the ISC learning cell and the process proceeds to step 506, where it is checked whether or not the learning counter LRNCTR is greater than 0. If LRNCTR is greater than 0, the ISC duty cycle ISCDTY during the learning period (i.e., LRNTM seconds) is on the average greater than the learning value LRNDTY, and thus LRNDTY is updated towards ISCDTY value by incrementing LRNDTY by a predetermined small amount d (say 0.1%) in step 507. Besides, ISCMIN is also incremented by amount d in step 508. On the other hand, if LRNCTR is less than 0, the ISC duty cycle during the learning period is on the average less than LRNDTY, and therefore LRNDTY is updated towards ISCDTY value by decrementing LRNDTY a small amount d in step 509. Then, in step 510, ISCMIN is decremented by amount d. It is obvious that both the learning timer LRNTM and the value of the incremental amount d determine the speed of learning.

Since LRNDTY determines the base open-loop ISC duty cycle value and ISCMIN determines the minimum allowed duty cycle, it is important that their values are always within the valid range: $LRNMIN \leqq LRNDTY \leqq LRNMAX$ and $LRNMIN-b1 \leqq ISCMIN \leqq BSDTY-b2$, where LRNMIN is a predetermined learning minimum value, LRNMAX is a predetermined learning maximum, BSDTY is a predetermined base duty cycle for the desired idling speed, b1 is a predetermined offset value, say 4%, and b2 is a predetermined high offset value, say 1%. Therefore, in the ISC learning routine (not shown in FIG. 9), whenever the KAM cells are updated, LRNDTY is checked and clipped to LRNMIN as the minimum and to LRNMAX as the maximum; besides, ISCMIN is checked and clipped to LRNMIN-b1 as the minimum and to BSDTY-b2 as the maximum, if necessary.

The learning base duty cycle cell LRNDTY is initialized to the base open-loop duty cycle BSDTY for the desired idling speed; while, the minimum duty cycle ISCMIN is initialized to the minimum learning limit LRNMIN. Moreover, these two values have to be checked once when turning on the ignition switch and thus powering up the vehicle. This is because they are stored in the KAM which can be written into a random value if the noise margin exceeds certain level.

Figure 10:
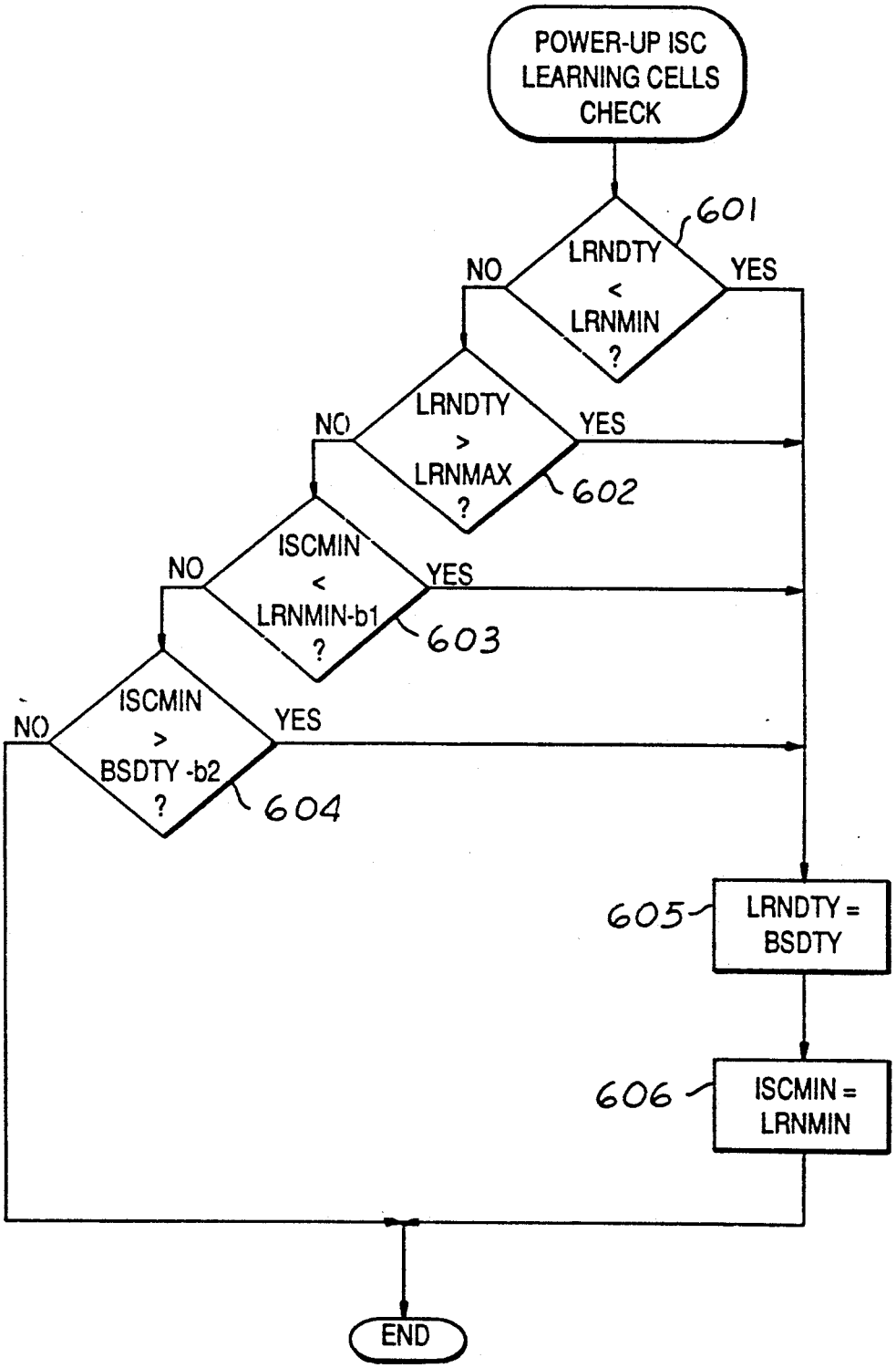
FIG. 10 is a flowchart illustrating the check and reinitialization of the ISC learning cell upon power up according to this invention.

FIG. 10 shows the flowchart of the learning cells checking routine. This routine is only executed once at power up. In step 601, LRNDTY is checked to see if it is less than the minimum value LRNMIN. If it is not less than the minimum value, the process proceeds to step 602 to check if it is greater than the maximum value LRNMAX. If it is not greater than the maximum value, the process proceeds to step 603 to check if ISCMIN is less than LRNMIN-b1. If the answer is no, the process proceeds to step 604 to check if it is greater than BSDTY-b2. If the answer is no, then LRNDTY is assumed valid and thus exit the routine. If the answer to any of steps 601 to 604 is positive, it is possible that KAM cells are corrupted, and thus reinitialize LRNDTY to the base ISC duty cycle value BSDTY as shown in step 605, and ISCMIN to LRNMIN as shown in step 606. Note that LRNMIN and LRNMAX have to be carefully selected such that LRNMIN<BSDTY<LRNMAX.

Various modifications and variations will no doubt occur to those skilled in the art to which this invention pertains. For example, the various predetermined parameters used in the idle speed control system may be varied from those disclosed herein. These and all other such variations are considered to come within the scope of the claims covering this invention.

I claim:

1. A method for engine idle speed control of an automobile internal combustion engine comprising the steps of:

measuring the engine revolution speed (rpm), the engine coolant temperature, the throttle position, and the time-since-engine-start;

calculating a rolling average of engine idle speed, a rolling average of the throttle position, a desired engine idle speed, and a dashpot duty cycle;

determining whether to use an open-loop idle speed control or a closed-loop idle speed control as a function of the above measured and calculated parameters; and controlling the duty cycle of an idle speed air bypass passage control valve in accordance with the selected open-loop control manner or closed-loop control manner.

2. A method as recited in claim 1 including the steps of:

selecting said dashpot duty cycle for controlling said idle speed air bypass valve as a function of the rolling average of the throttle position when the throttle valve is not closed; and decrementing said dashpot duty cycle by a function of the dashpot duty cycle until the throttle valve is closed.

3. A method as recited in claim 1 wherein said closed-loop control is used when the engine coolant temperature is greater than a predetermined value, the time-since-engine-start is greater than a predetermined value, the dashpot duty cycle is zero and the rolling average engine speed is smaller than the sum of the desired engine idle speed and a predetermined engine speed.

4. A method as recited in claim 3 wherein controlling the idle speed air bypass passage control valve in the closed-loop control manner includes establishing a closed-loop gain as a function of speed deviation of the rolling average engine speed from the desired engine idle speed.

5. A method as recited in claim 4 further comprising establishing an update time for changing the dashpot duty cycle for the air bypass passage control valve signal as a function of speed deviation of the rolling average engine speed from the desired engine idle speed.

6. A method as recited in claim 5 further comprising performing an instant dashpot duty cycle increase when the rolling average engine idle speed is below a desired speed minus a predetermined threshold and the engine idle speed is dropping to prevent an engine stall.

7. A method as recited in claim 6 further comprising performing an instant dashpot duty cycle decrease when the rolling average engine idle speed is above a desired speed plus a predetermined threshold and the engine idle speed is rising.

8. A method as recited in claim 7 further including load compensation during closed-loop control including the steps of:

checking to see whether an engine load has been actuated; and incrementing by a predetermined amount the duty cycle for controlling said idle speed air bypass passage control valve, thereby providing extra air immediately when the load is actuated and avoiding a substantial drop in engine speed which may cause rough engine operation or an engine stall.

9. A method as recited in claim 8 further comprising a method of load compensation during closed-loop idle speed control including the steps of:

determining whether an engine load has been eliminated; and reducing the dashpot duty cycle by a predetermined amount of the air bypass passage valve control signal, thereby preventing sudden excessive engine speed increase.

10. A method as recited in claim 9 further comprising an idle speed control learning routine including:

learning a base idle speed control duty cycle appropriate for the desired idle speed and storing it in a learning cell in a keep-alive memory; and learning a minimum idle speed control duty cycle and storing it in a learning cell in the keep-alive memory.

11. A method as recited in claim 10 wherein said idle speed control learning routine further comprises a learning cells checking routine at power up including the steps of:

checking if the learning base idle speed control duty cycle is less than a predetermined minimum;

checking if the learning base idle speed control duty cycle is greater than a predetermined maximum;

checking if the learning minimum idle speed control duty cycle is less than the predetermined minimum minus a predetermined value;

checking if the learning minimum idle speed control duty cycle is greater than the predetermined base idle speed control duty cycle minus a predetermined value; and if the answer to any of the previous checks is positive, reinitializing the learning base duty cycle to the predetermined base idle speed control duty cycle and reinitializing the learning minimum duty cycle to the predetermined minimum value.

12. A method as recited in claim 10 wherein said idle speed control learning routine further includes:

learning the base idle speed control duty cycle when the engine is running in the closed-loop idle speed control mode, the engine idle speed is relatively stable and close to the desired engine idle speed.

13. A method as recited in claim 12 wherein said idle speed control learning routine further includes:

learning a minimum idle speed control duty cycle so that the difference between the minimum idle speed control duty cycle and the learning base idle speed control duty cycle ia constant.

14. A method as recited in claim 13 wherein the idle speed control learning routine is executed if the following conditions are satisfied:

establishing that the rolling average engine idle speed is less than the sum of the desired engine speed and the first predetermined engine speed;

establishing that auxiliary engine loads, such a air-conditioning, are off;

establishing that the engine coolant temperature is less than a predetermined large value but greater than a predetermined small value; and establishing that the absolute value of the engine speed deviation is less than a predetermined threshold amount, thereby establishing that idle speed control learning is done only when the engine idle speed is relatively stabilized and the engine coolant temperature is within its normal range.

15. A method as recited in claim 14 further comprising resetting a learning counter and a real-time learning timer when said learning conditions are not satisfied.

16. A method as recited in claim 14 wherein the idle speed control learning routine further comprises the steps of:

comparing the learning base duty cycle stored in the keep-alive memory to the current idle speed control duty cycle;

incrementing the learning counter by 1 if the learning base duty cycle is smaller than the current duty cycle; and decrementing the learning counter by 1 if the learning base duty cycle is larger than the current duty cycle.

17. A method as recited in claim 16 further comprising the step of:

updating the learning base idle speed duty cycle and the minimum duty cycle stored in the keep-alive memory if the contents in the real-time learning timer are greater than a predetermined value.

18. A method as recited in claim 17 further comprising the steps of:

incrementing the learning duty cycle by a predetermined small amount when the learning counter is greater than zero, indicating the learning duty cycle is smaller than the actual duty cycle required to maintain the desired idle speed; and decrementing the learning base duty cycle by a predetermined small amount when the learning counter is less than zero, indicating the learning duty cycle is larger than the actual duty cycle required to maintain the desired idle speed.

19. A method as recited in claim 18 further comprising the steps of:

incrementing the minimum duty cycle by the said predetermined small amount when the learning counter is greater than zero; and decrementing the minimum duty cycle by the said predetermined small amount when the learning counter is less than zero.

20. A method for engine idle speed control of an automobile internal combustion engine comprising the steps of:

measuring the engine revolution speed (rpm), the engine coolant temperature, the throttle position, and the time-since-engine-start;

calculating a rolling average of engine idle speed, a rolling average of the throttle position, a desired engine idle speed, and a dashpot duty cycle;

determining whether to use a first mode of an open-loop idle speed, a second mode of an open-loop idle speed control, or a closed-loop idle speed control as a function of the above measured and calculated parameters; and controlling the duty cycle of an idle speed air bypass passage control valve in accordance with the selected first mode open-loop idle speed control, the second mode of open-loop idle speed control, or the closed-loop idle speed control.

21. A method as recited in claim 20 including selecting said first open-loop idle speed control mode when the engine coolant temperature is smaller than a predetermined value, the time-since-engine-start is less than a predetermined value and the closed-loop idle speed control has never been executed after engine starting.

22. A method for engine idle speed control as recited in claim 21 wherein the idle speed control duty cycle for said first open-loop idle speed control mode is the sum of the following terms:

a predetermined base idle speed control duty cycle if the predetermined base idle speed control duty cycle is greater than the learning base duty cycle, or the learning base duty cycle if the learning base duty cycle is greater than the predetermined base duty cycle;

a duty cycle adder for engine coolant temperature compensation;

a dashpot duty cycle adder for time-since-engine-start compensation; and a duty cycle adder for air-conditioning compensation if the air-conditioner is on.

23. A method for engine idle speed control as recited in claim 22 includes determining the predetermined base idle speed control duty cycle using the steps of:

starting the engine at sea level and running the engine until the engine coolant temperature is greater than a predetermined value;

turning the air-conditioner off;

forcing the idle speed control in the first open-loop idle speed control mode by setting the predetermined engine coolant temperature value for entering the closed-loop idle speed control to be a value much higher than the normal operation temperature;

adjusting the base idle speed control duty cycle until the desired idling engine speed is obtained; and using the obtained base duty cycle as the predetermined base idle speed control duty cycle for the first open-loop idle speed control mode.

24. A method as recited in claim 22 wherein said second open-loop idle speed control mode is used when the conditions for the closed-loop idle speed control and the conditions for said first open-loop idle speed control are not satisfied.

25. A method for engine idle speed control as recited in claim 24 wherein the idle speed control duty cycle for said second open-loop idle speed control mode is the sum of a base duty cycle and the dashpot duty cycle.

26. A method as recited in claim 25 wherein determining said base duty cycle includes the steps of:

checking if the previous idle speed control mode is the closed-loop idle speed control mode;

if the previous idle speed control mode is closed-loop idle speed control, using the current duty cycle as the base duty cycle; otherwise, checking if the air-conditioning switch has been changed from OFF to ON;

if the air-conditioning switch has been changed from OFF to ON, adding a predetermined duty cycle adder to the base duty cycle and using the resultant value as the new base duty cycle; otherwise, checking if the air-conditioning switch has been changed from ON to OFF;

if the air-conditioning switch has been changed from ON to OFF, subtracting a predetermined duty cycle adder from the base duty cycle and using the resultant value as the new base duty cycle; otherwise, maintaining the previous base duty cycle.

27. An engine idle speed control system for an automobile internal combustion engine comprising:

means for measuring the engine revolution speed (rpm), the engine coolant temperature, the throttle position, and the time-since-engine-start;

means for calculating a rolling average of engine idle speed, a rolling average of the throttle position, a desired engine idle speed, and a dashpot duty cycle;

means for determining whether to use an open-loop idle speed control mode or a closed-loop idle speed control mode as a function of the above measured and calculated parameters;

means for controlling the duty cycle of an idle speed air bypass passage control valve in accordance with the selected open-loop idle speed control mode or closed-loop idle speed control mode;

means for selecting said dashpot duty cycle for controlling said idle speed air bypass valve as a function of the rolling average of the throttle position when the throttle valve is not closed, and decrementing said dashpot duty cycle by a function of the dashpot duty cycle until the throttle valve is closed;

means for selecting said closed-loop idle speed control when the engine coolant temperature is greater than a predetermined value, the time-since-engine-start is greater than a predetermined value, the dashpot duty cycle is zero and the rolling average engine speed is smaller than the sum of the desired engine idle speed and a predetermined engine speed;

said means for controlling the idle speed air bypass passage control valve in the closed-loop idle speed control manner including means for establishing a closed-loop gain as a function of speed deviation of the rolling average engine speed from the desired engine idle speed;

means for establishing an update time for changing the dashpot duty cycle for the air bypass passage control valve signal as a function of speed deviation of the rolling average engine speed from the desired engine idle speed;

means for performing an instant dashpot duty cycle increase when the rolling average engine idle speed is below a desired speed minus a predetermined threshold and the engine idle speed is dropping to prevent an engine stall;

means for performing an instant dashpot duty cycle decrease when the rolling average engine idle speed is above a desired speed plus a predetermined threshold and the engine idle speed is rising;

means for load compensation during closed-loop idle speed control; and means for performing an idle speed control learning routine.

28. An engine idle speed control system as recited in claim 27 wherein said means for an idle speed control learning routine includes:

means for learning a base idle speed control duty cycle appropriate for the desired idle speed and storing it in a learning cell in a keep-alive memory;

means for learning a minimum idle speed control duty cycle and storing it in a learning cell in the keep-alive memory;

means for learning the base idle speed control duty cycle when the engine is running in the closed-loop idle speed control mode, the engine idle speed is relatively stable and close to the desired engine idle speed; and means for learning a minimum idle speed control duty cycle so that the difference between the minimum idle speed control duty cycle and the learning base idle speed control duty cycle is constant.

29. An engine idle speed control system as recited in claim 28 wherein said means for an idle speed control learning routine includes:

means for establishing that the rolling average engine idle speed is less than the sum of the desired engine rpm and the first predetermined rpm;

means for establishing that auxiliary engine loads, such as air-conditioning, are off;

means for establishing that the engine coolant temperature is less than a predetermined large value but greater than a predetermined small value; and means for establishing that the absolute value of the engine speed deviation is less than a predetermined threshold amount, thereby establishing that idle speed control learning is done only when the engine idle speed is relatively stabilized and the engine coolant temperature is within its normal range.

* * * * *

UNITED STATES PATENT AND TRADEMARK OFFICE

CERTIFICATE OF CORRECTION

PATENT NO. : 5,083,541

DATED : January 28, 1992

INVENTOR(S) : Bor-Dong Chen

It is certified that error appears in the above-identified patent and that said Letters Patent is hereby corrected as shown below:

Col. 17 lines 61 and 67 delete "dashpot"

Col. 18 lines 4 and 24 delete "dashpot"

Col. 18 line 68 substitute --is-- for "ia"

Col. 20 line 29 delete "dashpot"

Col. 21 line 51 delete "dashpot"

Col. 22 lines 3 and 8 delete "dashpot"

Signed and Sealed this

Twentieth Day of July, 1993

*Attest:*

Michael K. Kirk

MICHAEL K. KIRK

*Attesting Officer*

*Acting Commissioner of Patents and Trademarks*